United States Patent [19]

Grassi et al.

[11] Patent Number: 5,012,753

[45] Date of Patent: May 7, 1991

[54] MECHANISM FOR TENSIONING A FABRIC PLATFORM

[76] Inventors: David Grassi, 675 A Castro St., San Francisco, Calif. 94114; James K. Antrim, 4018 Archery Way, El Sobrante, Calif. 94803

[21] Appl. No.: 189,322

[22] Filed: May 2, 1988

Related U.S. Application Data

[63] Continuation-in-part of Ser. No. 812,294, Dec. 23, 1985, abandoned.

[51] Int. Cl.[5] ..... B63B 3/48

[52] U.S. Cl. ..... 114/39.1; 108/128; 114/61; 114/85

[58] Field of Search ..... 114/39.1, 61, 354, 85; 108/128; 135/98, 20 R, 36 F

[56] References Cited

U.S. PATENT DOCUMENTS

| | | | |
|---|---|---|---|
| 1,741,846 | 12/1929 | Kahn | 135/36 F |
| 2,483,585 | 10/1949 | Lewis | 135/98 X |
| 2,785,735 | 3/1957 | Banks | 108/128 |
| 3,831,539 | 8/1974 | Black | 114/39 |
| 4,333,412 | 6/1982 | McKenna | 114/39 |

FOREIGN PATENT DOCUMENTS

| | | | |
|---|---|---|---|
| 2649577 | 3/1978 | Fed. Rep. of Germany | 114/61 |
| 566631 | 2/1924 | France | 108/128 |
| 1293790 | 4/1962 | France | 135/98 |

*Primary Examiner*—Sherman D. Basinger

[57] ABSTRACT

A light weight and collapsible platform and platform support structure usable as the deck and central structure of a folding boat and of a levelable, raised platform tent camper. This collapsible platform support structure is a unique arrangmeent of compression carrying arms radiating out from a central hub and jacking device, with an arrangement of tension carrying cables linking and supporting the radial arms into a rigid geometry. By concept and design the structure maximizes horizontal platform area for a minimum of weight and structure. Light weight allows transportability and collaspsibility allows stowability. The structure is opened from a collapsed state to a rigid erected state by operation of the jack, which moves the cable hub away from the arm hub. This action rotates the arms downward, loading the arms in compression and the cables and platform in tension, eventually locking the the structure into it's rigid erected geometry. Necessary auxiliary items can be fastened to this rigid geometric structure to allow it to float and be propelled and controlled when in the water, and to be leveled and moved about when on land.

25 Claims, 2 Drawing Sheets

MECHANISM FOR TENSIONING A FABRIC PLATFORM

This is a continuation-in part of Ser. No. C-I-P of Ser. No. 812,294 filed Dec. 23, 1985 and now abandoned.

BACKGROUND

1. Field of the Invention

The invention relates to tensionable fabric platforms and especially to a collapsible structure and mechanism which tensions and supports such a platform that is the deck of a boat or is a raised platform for tent camping.

CROSS REFERENCE

Our co-pending application, Ser. No. 814 522, Filed Dec. 23, 1985, shows a tent specially adapted for use with the present invention. Ser. No. 814,552 is now abandoned.

2. Description of Prior Art

Many camping enthusiasts prefer to camp near a body of water and often carry or trailer a boat to enjoy water-related activities. Most camping platforms are either cumbersome and stationary, such as wood platforms, or are very manufactured and sophisticated enclosures such as fold-out trailers with mattresses. Heretofore, even minimalist platforms such as trampolines of catamaran sailboats or other erectable tubular constructions were heavy and not easily transportable. Set up was often arduous and time consuming and often required tools. They were not levelable for use as a camping platform on load; nor were they adaptable to camping activities both on land and on water.

Prior mechanisms for stretched fabric platforms did not include a cable running around the perimeter of the fabric, which when tensioned by an outward thrusting of radial arms, translates this tension into the fabric platform. Nor did prior inventions of this type employ a catenary or parabolic sag, cut into the perimeter curve of the fabric platform, which by the nature of the curve will impart an evenly distributed tension into the fabric along the length of the cable.

OBJECTS AND ADVANTAGES

Accordingly, we claim the following as our objects and advantages of the invention: to provide a structural system to support a platform for human usage and activities that is very light weight to carry or transport due to its imaginative design resulting in minimal cross sections of structural elements; that is extremely easy to erect by a layperson with no tools necessary by simply cranking a handle; and that is is amazingly compact when folded considering the large platform area when erected. A further object and advantage of our invention is to hold rigid and separate two flotation devices as in the hulls of a catamaran sailboat, and to support a fabric platform between said two hulls affording boat users a large waterborne platform from which to enjoy activities including but not limited to fishing, sunbathing, sight-seeing, etc. The above mentioned collapsible platform structure is equally useful for camping activities on land in that said collapsible platform structure can be leveled by means of extending its camper legs to compensate for unlevel terrain. Thus campers will have a smooth, level surface for relaxing and sleeping in a setting of their choosing. Its light weight combined with its unique wheels used as keels make it eminently moveable to interesting locations in the landscape where camper vans and trailers could not practically venture.

Readers will find further objects and advantages of the invention from a consideration of the following description and the accompanying drawings.

DRAWING FIGURES

Figures 1, 2:
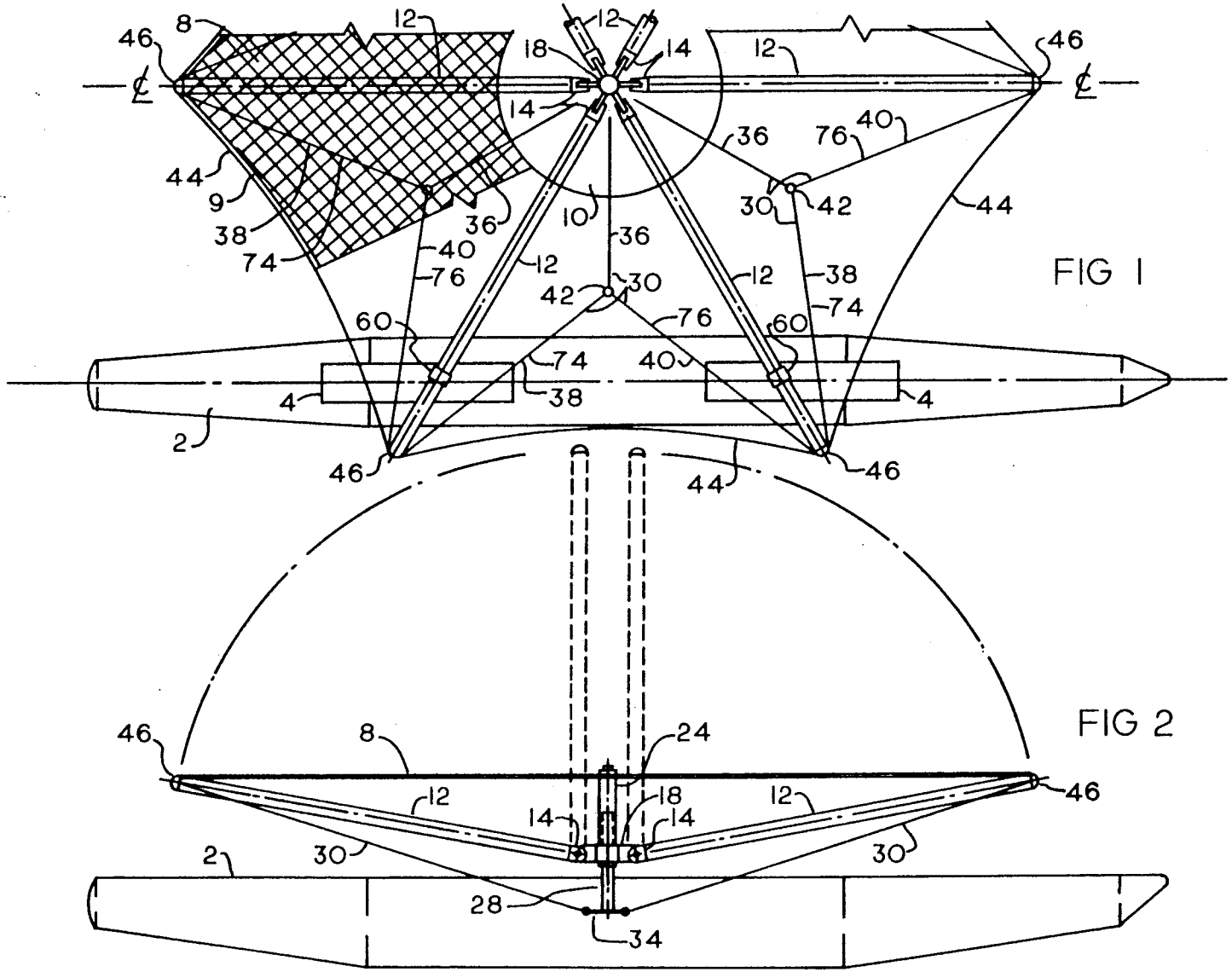
FIG. 1 shows an overhead plan view of the platform and supporting structure as positioned for use as the deck of a catamaran boat. The boat and structure are symmetrical about the boat's longitudinal centerline; so only the starboard side is shown.
FIG. 2 shows a section through the structure as positioned on a hull. The section is taken just to starboard of centerline.

DRAWING REFERENCE NUMERALS 2 hull
4 saddle
6 saddle cable clamp
8 platform
9 perimeter sleeve
10 foot hole in platform
12 radial arm
14 fork
16 pin
18 arm hub
20 fin
22 hollow stock
24 jack
26 jack handle
28 center vertical strut
30 radial cable system
32 eye
34 cable hub
36 cable
38 cable
40 cable
42 cable junction fitting
44 perimeter cable
46 arm end fitting
48 cable clamp
50 screw
52 stanchion
54 leg casing
56 leg
58 foot
60 hinge plate
62 pin
64 pin
66 cable clamp plate
68 eye
70 hook
72 cable
74 cable
76 cable

COLLAPSIBLE PLATFORM STRUCTURE DESCRIPTION

The essence of our invention is shown in FIGS. 1 and 2. Our invention comprises a structure and a supported platform 8. The outer bounds of the central structure are hexagonal in plan view and conical in profile when the structure is erected. The flat base of the conical shape is the supported hexagonal platform area which is the uppermost plane of the structure.

When the structure is folded its bounds are roughly defined by an elongated cylinder the central axis of which is the axis of the above mentioned conical shape when erected.

Arranged coincentrically along the central vertical axis as described are a cable hub 34, rigidly fixed to the bottom of a center vertical strut 28, which slides in and out of a screw jack 24 and is connected to and forcibly moved by daid jack, and an arm hub 18. Jack 24 can also be a scissor, hydrayulic, or lever jack.

The cable hub 34 is at the apex of the described conical boundary and is a flat plate in profile, round or hexagonal in plan, with six equally spaced holes drilled around the perimeter. Each of the six identical radial cable systems 30 are attached to the cable hub 34 by means of an eye 32 fastened through one of the holes in the cable hub 34. One cable system 30 is fastened to each hole.

The arm hub 18 is a one piece casting or weldment consisting of a hollow stock 22 and six identical flat plate fins 20. The axis of the hollow stock 22 lies along the center vertical axis. The hollow stock 22 of the arm hub 18 is rigidly fixed to the shell of the jack 24. The fins 20 are quadrilateral in profile and radiate outward from the hollow stock 22 at equal angular spacing from one another. The flat plate of the fin 20 is in a vertical plane.

Each fin 20 has a horizontal axis hole to accept a pin 16 for attachment of a fork 14. Each fork 14 is a casting rigidly fixed in the end of a radial arm 12. There are six radial arms 12, one per fin 20. The radial arms 12 radiate outward from the arm hub 18 to the corners of the described erected hexagon. The described attachment of the fork 14 to the fin 20 at the inner end of the radial arms 12 allows rotation in a vertical plane so that the radial arms 12 are vertical and parallel when the structure is folded.

The platform 8 at the uppermost plane of the erected structure is a fabric trampoline which is shaped like a concave sided hexagon in plan. The concave sides are cut in the shape of a parabolic or catenary curve. A catenary curve would be preferred for a homogeneous fabric such as a film, while a parabolic curve would be preferred for a warp/weft woven or biaxial fabric. As an example, the platform 8 is sized to fit within a cirle of 14 foot diameter. A round hole may be cut in the platform's center, sized to accommodate leg room for sitting. A cable 14 runs through a sleeve 9 in its perimeter in a continuous loop.

The perimeter cable 44 is fastened to the outer ends of the radial arms 12 and the outer ends of the radial cable systems 30 at the arm end fitting 46. The arm end fitting 46 is a casting grooved to accept two cables, holed to accept a third cable hooked from the bottom and holed on top to accept a vertical stanchion 52. The perimeter cable 44 and the radial cable system 30 pass the arm end fitting 46 and are locked in place by a cable clamp 40 held by a screw 50.

Each of the six radial cable systems 30 is identical and consists of three cables in a Y pattern. The base of the Y is a cable 36 connected by an eye 32 to the cable hub 34. This cable 36 radiates out from the hub 34 in plan view at an angle bisecting the angle between the radial arms 12. At the cable junction fitting 42 the cable 36 connects with the two cables 38 and 40, forming the top legs of the Y. These two cables run out and clamp to the arm end fitting 46 as previously described. The cable 38 is continuous with the cable 40 of the adjacent radial cable system 30.

Figure 3:
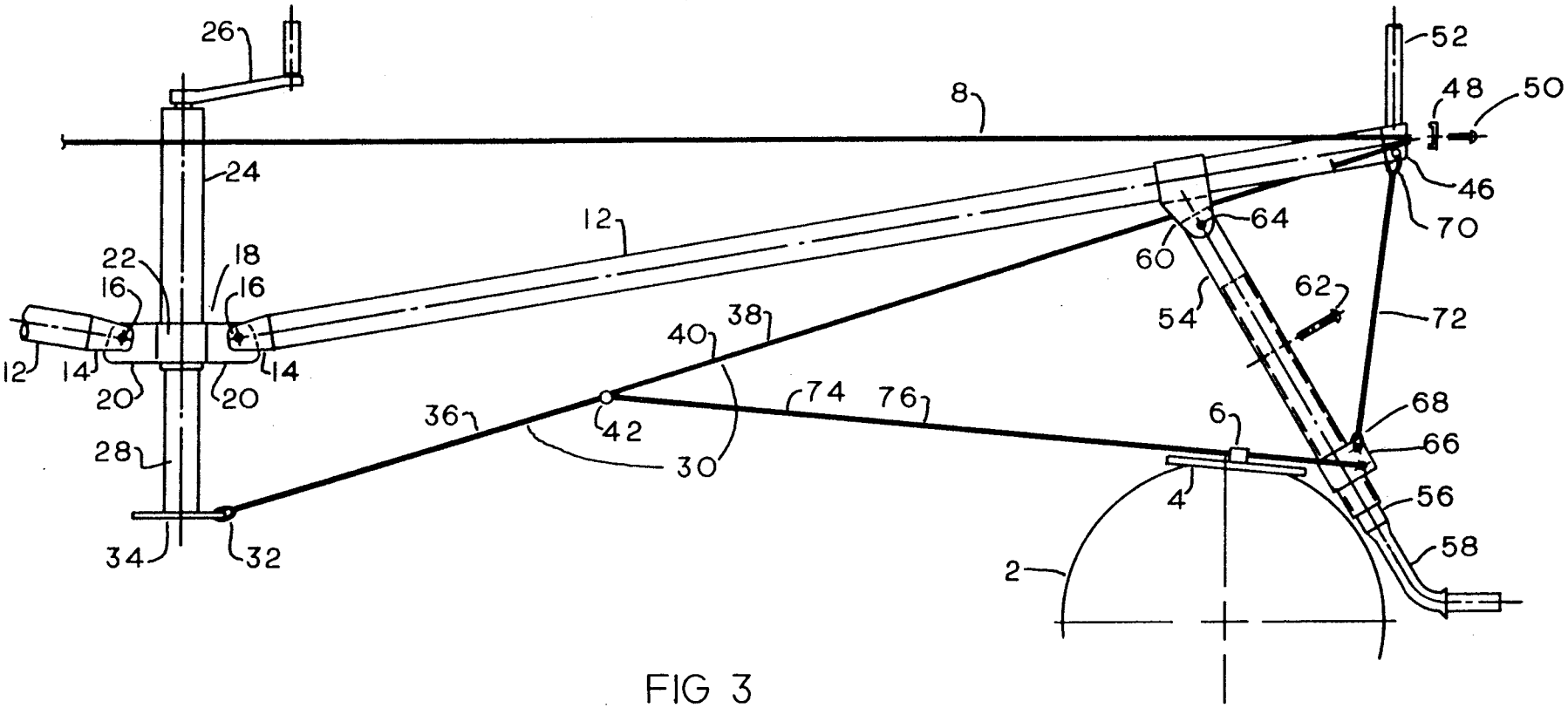
FIG. 3 shows a typical section through the support structure just to one side of a radial arm, detailing the attachment of a leg.

FIG. 3 shoes a larger profile view of one of the six radial arms 12 and attendant structure as described above. Also shown in this view is a typical attachment of a leg casing 54 and a leg 56 with their supporting cable system.

A cast foot 58 is rigidly fixed to the leg 56. The leg 56 slides coincentrically in the leg casing 54 and can be fixed at a given height by fitting a pin 62 into a series of holes in the leg 56.

Geometry of the leg 56 is such that when the leg 56 is fully retracted, the foot 58 will lie just outside of the arm end fitting 46 and will sit on a plane at or slightly below the cable hub 34. The leg 56 and leg casing 54 angle upwards and inwards at 30 degrees until they meet the radial arm 12. The upper end of the leg casing 54 is connected by a pin 64 to a hinge plate 60 so as to allow rotation of the leg 56 in the plane of the radial arm 12. The hinge plate 60 is rigidly fixed to the radial arm 12.

The leg system is stabilized by a three cable staying system. All cables fasten to a cable clamp plate 66 which is rigidly fixed at the base of the leg casing 54. A cable 74 originates at the cable junction fitting 42 and runs down to and around the base of the leg casing 54 where it is clamped in place by a clamp plate 66. This same cable, now notated as cable 76, runs up to the adjacent cable junction fitting 42 where it ends and is fixed. The layout of the cable 74 and the cable 76 is such that in plan view they lie directly below the cable 38 and the cable 40 respectively. The third cable of the three cable leg support system is the cable 72 which is fastened by an eye 68 to the cable clamp plate 66 and runs vertically up to fasten to the arm end fitting 46 by means of a hook 70.

A hull 2 with an attahced saddle 4 may be fastened to the structure by means of a cable clamp 6.

COLLAPSIBLE PLATFORM STRUCTURE

OPERATION

As described above the collapsible platform structure when folded is roughly in the shape of an elongated cylinder, with a length slightly longer than the radial arms 12.

To open the structure a user would stand the bundle on red with the cable hub 34 on the ground and the six radial arms 12 pointing vertically upwards. The arms would be allowed to flop to the ground, rotating about the pin 16. The structure would then lie loosely; but the platform would be opened to its erected hexagonal shape.

The user then cranks the jack 24, forcing the cable hub 34 away from the radial arm hub 18. This action loads the radial arms 12 in compression and the radial cable systems 30 and the perimeter cable 44 in tension. Due to the parabolic or catenary sag defined by the sleeve 9, the tensile load is uniformly distributed by the perimeter cable 44 into the fabric platform 8. Eventually the jacking action develops enough tension in the trampoline to support people, and locks the whole structure into a rigid geometry.

The leg casings 54 and the legs 56 which have been folded inward to lie along the radial arms 12 are now rotated downwards and outwards until the two inner leg supporting cables 74 and 76 are drawn tight. At this point the hook 70 at the end of the third leg cable 72 is fastened to the arm end fitting 46, thus stabilizing the leg casing 54.

For camping use, the platform 8 may be leveled by sliding the leg 56 in the leg casing 54 and fastening the leg 56 at an appropriate height with a pin 62.

For boating, a hull 2 with a saddle 4 may be fastened to the leg supporting cables 74 and 76 with the saddle cable clamp 6.

SUMMARY, RAMIFICATIONS, AND SCOPE

Thus the reader would see that we have provided a collapsible platform structure that combines multiple usage, compactness when folded, light weight, ease of erection, and transportability.

While the above description contains many specificities, the reader should not construe these as limitations on the scope of the invention, but merely as exemplification of the preferred embodiment thereof. For example, the radial cable systems can consist of a single cable running from the radial cable hub to the outer end of the radial arm; any type of jack can be used to load the sytems; with a strong trampoline matrial the perimeter cable might be eliminated; and many variations are possible on all the fittings and joints. The inventors have built and tested many of these embodiments. Accordingly the reader is requested to determine the scope of the invention by the appended claims and their legal equivalents, and not by the examples which have been given.

We claim:

1. In combination, a flat fabric platform with a perimeter shaped as a series of connected parabolic or catenary curves between support points, and a means for tensioning said fabric platform comprising:

(a) a cable enclosed within a sleeve around said perimeter of said platform, said sleeve and said cable following said catenary or parabolic perimeter curve, (b) at least three radial arms pivotably connected to and extending out from a radial arm hub and connected at their outer ends to said perimeter cable to form said support points, (c) at least one radial cable for each of said radial arms connected to an extending out from a radial cable hub and connected at its outer end to or near the outer end of said radial arm, and (d) means for connecting said radial arm hub to said radial cable hub and for moving said radial cable hub away from said radial arm hub in an axial direction generally perpendicular to said radial arms and said radial cable.

2. The invention of claim 1 wherein the center of said radial cable hub lies along an axis perpendicular to the center of said platform and the center of said radial arm hub lies between said platform and said cable hub and along said axis.

3. The invention of claim 2 wherein said radial arms are straight tubes.

4. The invention of claim 2 wherein said radial arms are four in number.

5. The invention of claim 2 wherein said radial arms are six in number.

6. The invention of claim 2 wherein said connecting and moving means is a jacking device.

7. The invention of claim 6 wherein said jacking device is a screw jack.

8. The invention of claim 6 wherein said jacking device is a hydraulic jack.

9. The invention of claim 6 wherein said jacking device is a scissor jack.

10. The invention of claim 6 wherein said jacking device is a lever jack.

11. The invention in claim 2 further including a round hole in the center of said platform sized to accommodate the legs of people seated on the platform.

12. The invention in claim 2 wherein said at least one radial cable comprises a radial cable bisecting the angle between adjacent radial arm and connected at its inner end to said radial cable hub and at its outer end to a cable junction fitting and two additional cables connected at their inner ends to said cable junction fitting and each connected at its outer end to or near the outer end of one of said adjacent radial arms.

13. The invention in claim 2 further including a leg extending downward from each of at least three of said radial arms and attached at the upper end of said leg at or near the outer end of said radial arms.

14. The invention of claim 13 wherein the lower ends of said legs may be attached to flotation devices.

15. A catamaran sailboat of the type having a flat tensioned fabric deck and collapsible structure to support said fabric deck and to serve as a connecting structure between said fabric deck and the two hulls of said sailboat, the improvement wherein, said fabric deck has a perimeter shaped as a series of connected parabolic or catenary curves between support points, and a means for tensioning said fabric platform comprising:

(a) a cable enclosed within a sleeve around the perimeter of said platform, said sleeve and said cable following said catenary or parabolic perimeter curves, (b) at least three radial arms pivotably connected to and extending out from a radial arm hub and connected at the outer ends of said radial arms to said perimeter cable to form said support points, (c) at least one radial cable for each of said radial arms connected to ane extending out from a radial cable hub and connected at its outer end to or near the outer end of said radial arm, with the center of said radial cable hub lying along an axis perpendicular to the center of said platform and the center of said radial arm hub lying between said platform and said cable hub and along said axis, and (d) means for connecting said radial arm hub to said radial cable hub and for moving said radial cable hub away from said radial arm hub in an axial direction generally perpendicular to said radial arms and said radial cable.

16. The invention of claim 15 wherein said radial arms are four in number.

17. The invention of claim 15 wherein said radial arms are six in number.

18. The invention of claim 15 wherein said connecting and moving means is a jacking device.

19. The invention of claim 18 wherein said jacking device is a screw jack.

20. The invention of claim 18 wherein said jacking device is a hydraulic jack.

21. The invention of claim 18 wherein said jacking device is a scissor jack.

22. The invention of claim 18 wherein said jacking device is a lever jack.

23. The invention in claim 18 further including a round hole in the center of said platform sized to accommodate the legs of people seated on the platform.

24. The invention in claim 18 wherein said at least one radial cable comprises a radial cable bisecting between the angle between adjacent radial arms and connected at its inner end to said radial cable hub and at its outer end to a cable junction fitting and two additional cables connected at their inner ends to said cable junction fitting and each connected at its outer end to or near the outer end of one of said adjacent radial arms.

25. The invention in claim 18 further including a leg extending downward from each of at least three of said radial arms and attached at the upper end of said leg at or near the outer end of said radial arms.

* * * * *